US006063994A

United States Patent [19]

Kew et al.

[11] Patent Number: 6,063,994

[45] Date of Patent: May 16, 2000

[54] SIMULATED STRING INSTRUMENT USING A KEYBOARD

[75] Inventors: Yong Fatt Kew; Kok Leong Chia, both of Singapore, Singapore

[73] Assignee: Creative Technology Ltd., Singapore, Singapore

[21] Appl. No.: 08/846,091

[22] Filed: May 1, 1997

[51] Int. Cl.[7] ..... G10H 7/00

[52] U.S. Cl. ..... 84/600; 84/744

[58] Field of Search ..... 84/622, 659, 600, 84/744–746

[56] References Cited

U.S. PATENT DOCUMENTS

| | | | |
|---|---|---|---|
| 4,379,420 | 4/1983 | Deutsch . | |
| 5,136,914 | 8/1992 | Letts et al. | 84/622 X |
| 5,646,648 | 7/1997 | Bertram | 84/423 R X |
| 5,726,374 | 3/1998 | Vandervoort | 84/638 |

OTHER PUBLICATIONS

Howling Dog FAQ, "Power Chords Pro FAQ (Frequently Asked Questions)," www.howlingdog.com/powfaq.htm, the last update was Nov. 8, 1995, pp. 1–3.

Power Chords Pro Screenshots, "Power Chords Pro Screenshots," www.howlingdog.com/screen.htm, Copyright 1996, pp. 1–3.

Power Chords by Howling Dog Systems, "Power Chords Pro," www.howlingdog.com/powercho.htm, Copyright 1996, pp. 1–2.

*Primary Examiner*—Jeffrey W. Donels

*Attorney, Agent, or Firm*—Townsend and Townsend and Crew LLP

[57] ABSTRACT

An economical simulated string instrument system that facilitates a performance both visually and aurally similar to a real string instrument performance. One particular embodiment is a simulated guitar implemented on a personal computer where standard personal computer keyboard keys are mapped to guitar controls so that the performer can hold and manipulate the keyboard in much the same way as a real guitar. This embodiment, however, provides flexibility and ease of play not offered by the real instrument.

26 Claims, 10 Drawing Sheets

SIMULATED STRING INSTRUMENT USING A KEYBOARD

BACKGROUND OF THE INVENTION

The present invention relates to computer implementation of musical instruments and more particularly to a computer emulation of a string instrument, e.g., a guitar.

Playing a string instrument such as a guitar provides enjoyment but unfortunately requires both musical skill and proper equipment. To learn to play the guitar requires musical aptitude, manual dexterity, and long practice. Even after the instrument is mastered, playing a tune by plucking or strumming the stiff strings of a guitar is physically demanding, causing the performer pain and calloused fingertips.

It is known to use an electronic synthesizer or a general purpose computer to play guitar-like sounds, but not as a real-time performance. The Power Chords Pro product available from Howling Dog Systems, Inc. of Sydenham, Ontario, Canada provides an ability to develop MIDI data that plays as a guitar-like sound. This product displays an on screen keyboard and fretboard with strings which can be used to create chords. Mouse operations can be used to simulate a chord. There is no ability to simulate real-time guitar performance.

What is needed is a simulated guitar that allows relatively musically unskilled performers to easily give a performance that is both visually and aurally similar to a performance with a real guitar. The simulated guitar should use generally available equipment.

SUMMARY OF THE INVENTION

The present invention provides a simulated string instrument system that facilitates a performance both visually and aurally similar to a real string instrument performance. One particular embodiment is a simulated guitar implemented on a personal computer where standard personal computer keyboard keys are mapped to guitar controls so that the performer can hold and manipulate the keyboard in much the same way as a real guitar. This embodiment, however provides flexibility and ease of play not offered by the real instrument.

In accordance with one aspect of the present invention, a computer-implemented method for simulating a string instrument includes steps of receiving from a keyboard a signal indicating depression of a particular key, and controlling musical output responsive to the key depression signal in accordance with a position of the particular key on the keyboard. The position is interpreted as an analogous position on the string instrument.

A further understanding of the nature and advantages of the inventions herein may be realized by reference to the remaining portions of the specification and the attached drawings.

DESCRIPTION OF SPECIFIC EMBODIMENTS

The present invention provides a simulated string instrument system. One implementation takes advantage of a personal computer keyboard. The following discussion begins with a description of a representative computer system for implementing a simulated string instrument. A description of the real-time instrument operation from a user perspective follows. Then, the visual user interface for controlling instrument parameters is described. The description refers to simulation of a guitar but any musical instrument that is, e.g., controlled by touch, may be simulated in accordance with the present invention.

Figure 1A:
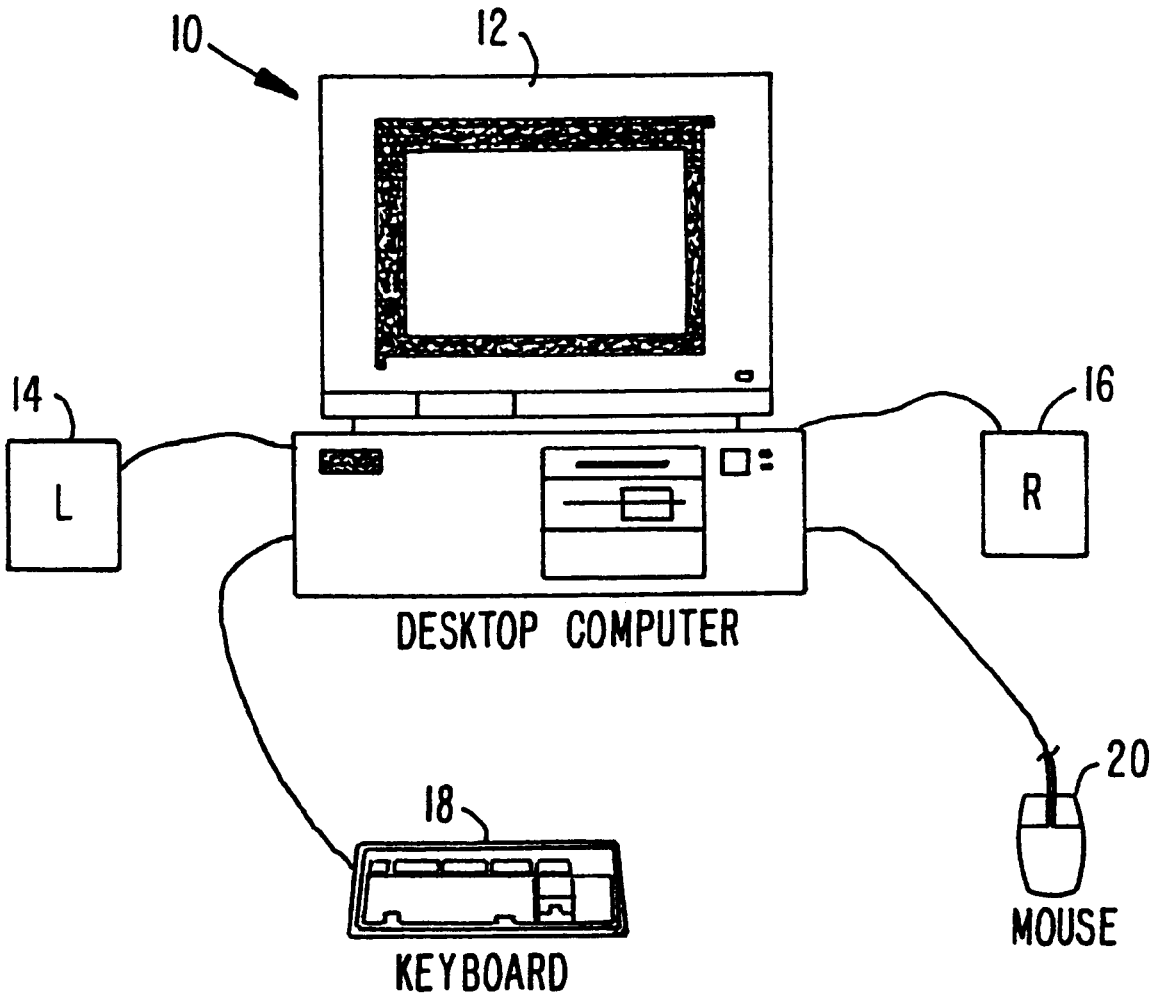
FIGS. 1A–1B depict a computer system suitable for implementing the present invention.

FIG. 1A depicts a representative multimedia personal computer 10 with a monitor 12, left and right speakers 14 and 16, a keyboard 18, and a mouse 20. This is an exemplary system that may be enhanced in accordance with the invention to simulate both the visual and aural aspects of guitar operation.

Figure 1B:
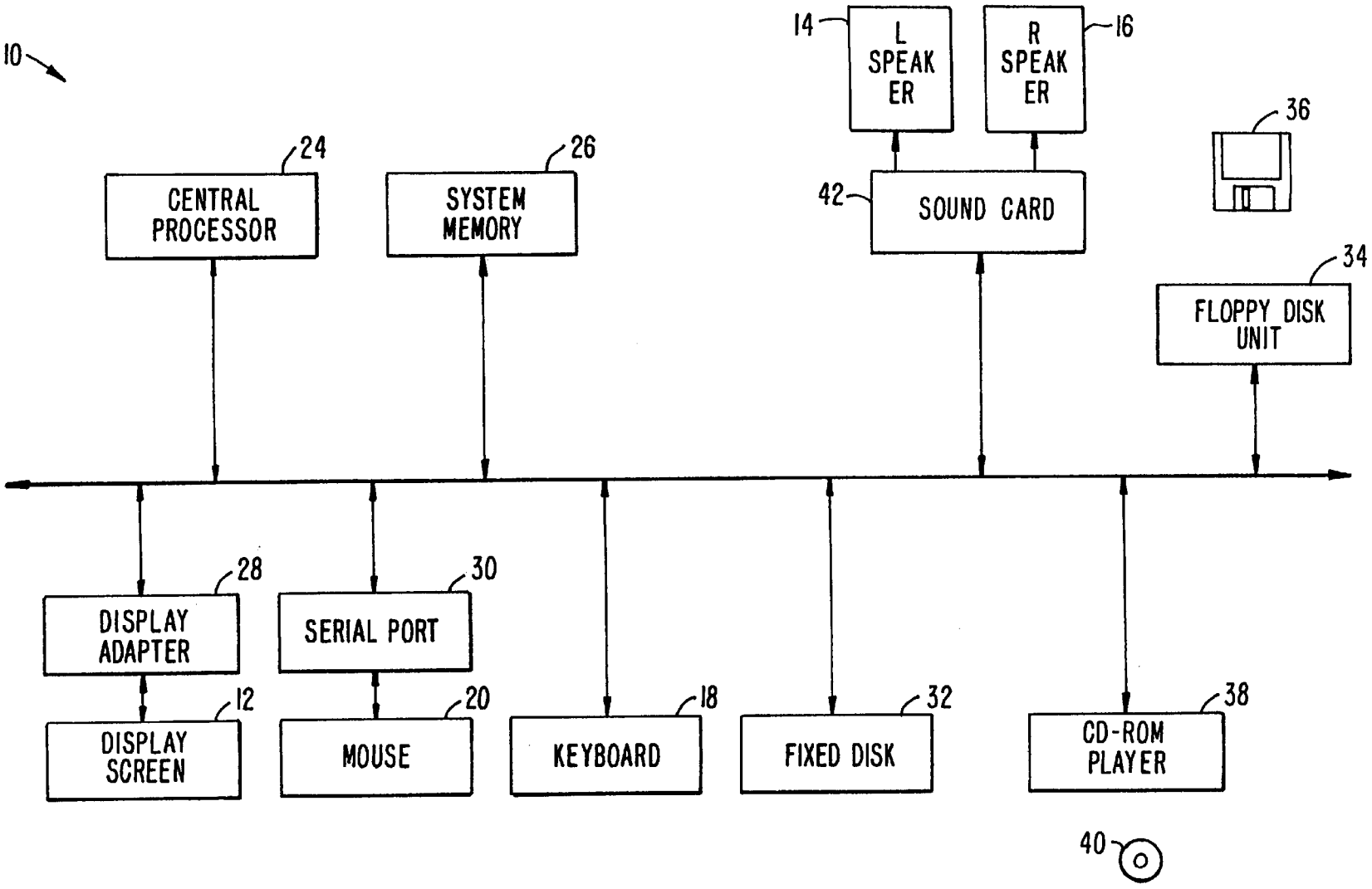

FIG. 1B depicts a simplified representation of the internal architecture of multimedia personal computer system 10 in accordance with one embodiment of the present invention. Computer system 10 includes a bus 22 which interconnects major subsystems such as a central processor 24, a system memory 26, display screen 12 via a display adapter 28, a serial port 30, keyboard 18, a fixed disk drive 32, a floppy disk drive 34 operative to receive a floppy disk 36, and a CD-ROM player 38 operative to receive a CD-ROM platter 40. In this representative embodiment, mouse 20 is depicted as connected via serial port 30. A sound card 42, such as the SoundBlaster® available from the assignee of the present application, drives left speaker 14 and right speaker 16 responsive to stored audio data. In accordance with the present invention, the speaker output simulates sound of a string instrument. Many other devices or subsystems (not shown) may be connected in a similar manner. Software to implement the present invention and audio data may be operably disposed in system memory 26 or stored on storage media such as a fixed disk 32, on floppy disk 36, or CD-ROM platter 40.

Figure 2A:
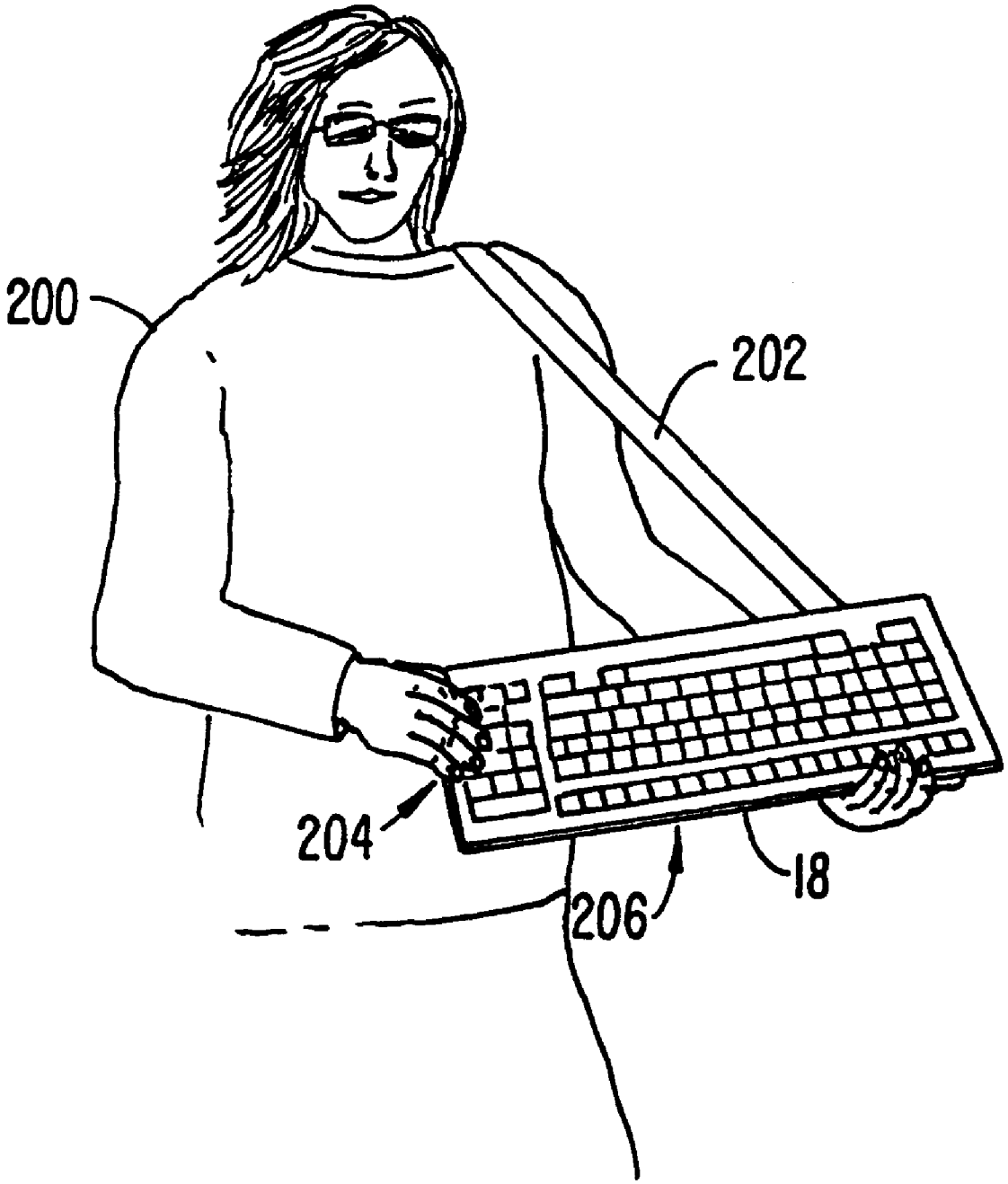
FIG. 2A depicts a performer operating a keyboard as a simulated guitar in accordance with one embodiment of the present invention.

FIG. 2A depicts a performer 200 operating keyboard 18 as a simulated guitar in accordance with one embodiment of the present invention. A strap 202 is threaded through apertures of folding legs (not shown) of keyboard 18. Performer 200 holds keyboard 18 as if it were a guitar. Keyboard 18 is preferably a standard personal computer keyboard as well known in the art. Performer 200 orients keyboard 18 so that a numeric keypad section 204 is on his or her right side. A set of function keys F1 through F12 206 are then along the bottom edge of keyboard 18.

Figure 2B:
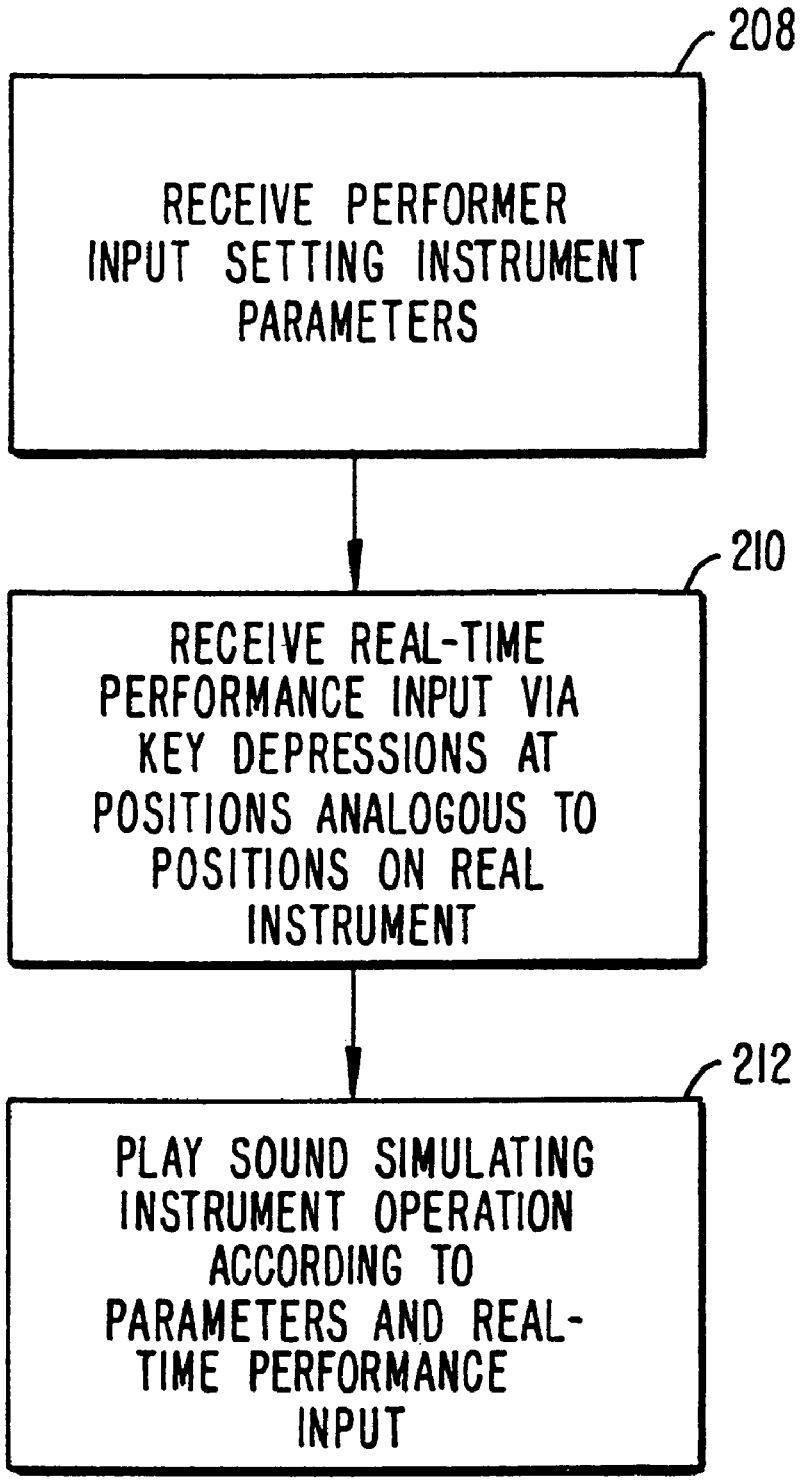
FIG. 2B depicts a flowchart generally describing steps of the operation of one embodiment of the present invention.

FIG. 2B depicts a flowchart generally describing steps of the operation of one embodiment of the present invention. At step 208, computer system 10 receives performer input setting instrument parameters. In a guitar embodiment, this may include specification and selection of chords, selection of guitar "style," and pitch shifting as an offset from the selected chord. At step 210, computer system 10 receives real-time performance input. This input may include keyboard depressions and manipulations of mouse 20 or some other input device. Preferably, the key depressions are at positions on keyboard 18 analogous to positions on a real guitar used to control the guitar. At step 212, computer system plays sound in real-time corresponding to the parameters set at step 208 and the real-time performance input received at step 210. Although, the steps of FIG. 2B are shown sequentially, it will be appreciated that steps 208 and 210 operate effectively in parallel as a real-time performance process. This real-time performance process may or may not be interrupted by user input of parameters at step 208.

Figure 3A:
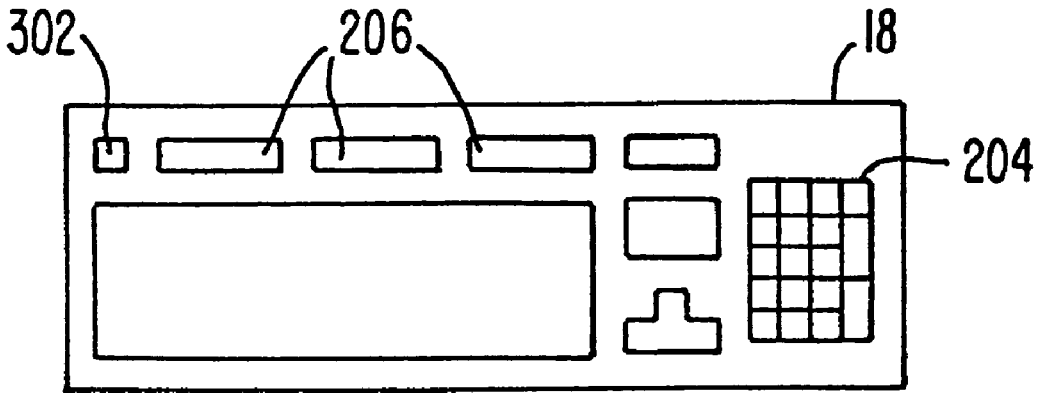
FIGS. 3A–3B depict mappings between keyboard keys and guitar operations in accordance with one embodiment of the present invention.
Figure 3B:
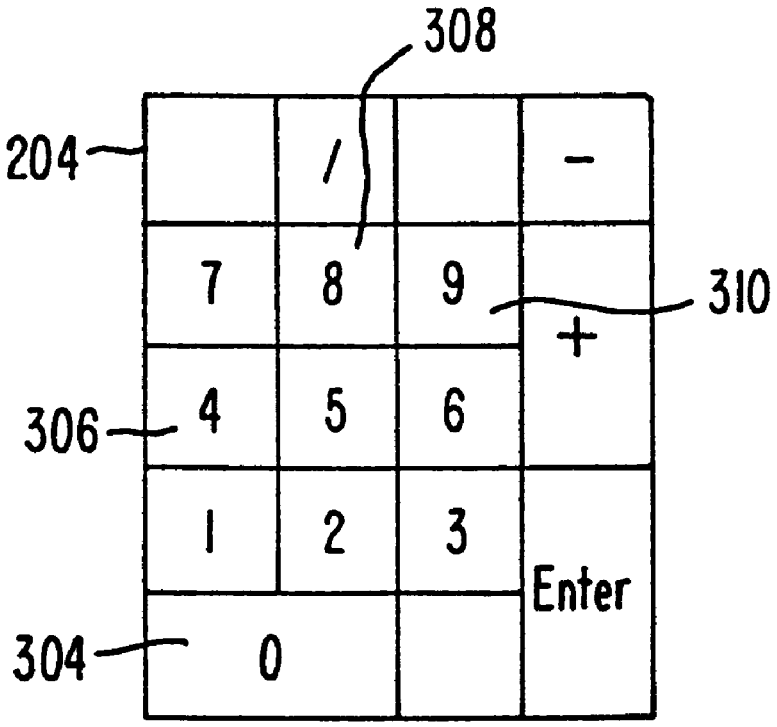

FIGS. 3A–3B depict mappings between keyboard keys and guitar operations in accordance with one embodiment of the present invention. FIG. 3A depicts an enlarged view of keyboard 18. Function keys 206 are used to select chords. Each function key has an associated chord. Performer 200 selects a chord by depressing the associated function key. The correspondences between function keys and chords is referred to herein as a "chord palette. " Preferably, multiple chord palettes are available for use. Performer 200 toggles through available chord palettes by depressing an escape key 302. Depression of keys on numeric keypad 204 simulates plucking of guitar strings.

FIG. 3B depicts an enlarged view of numeric keypad 204. Depression of a "0" key 304 simulates plucking of the string that would be plucked by the thumb. Depression of a "4" key 306 simulates plucking of the string that would be plucked by the index finger. Depression of an "8" key 308 simulates plucking of the string that would be plucked by the middle finger. Depression of a "9" key 310 simulates plucking of the string that would be plucked by the ring finger.

A feature provided by one embodiment is that performer 200 need not know which strings are to be plucked for a particular chord. For beginning play, for a given chord only four of the six strings on a real guitar are plucked. The numeric keypad keys, 304, 306, 308, and 310 are automatically mapped to simulate plucking of the strings corresponding to the currently selected chord. The two strings not used by the currently selected chord need not be mapped to keys.

The mappings shown in FIGS. 3A–3B are of course merely representative of possible mappings that would analogize key position on keyboard 18. to the positions on a real guitar used for real-time control of a performance. Since performer 200 holds and operates keyboard 18 in much the same way as a real guitar, the visual performance is similar.

Figure 4:
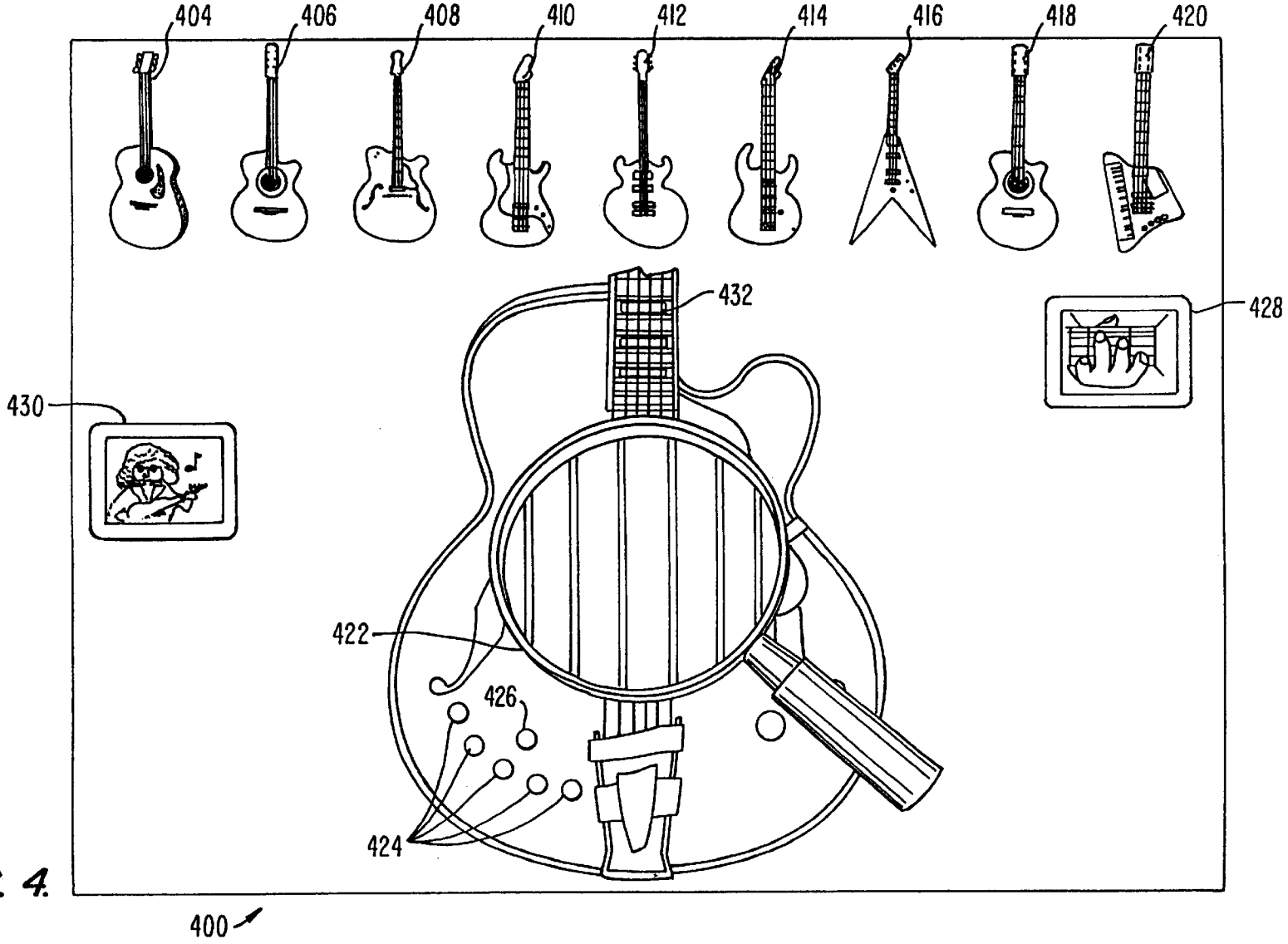
FIG. 4 depicts a primary user interface display in accordance with one embodiment of the present invention.

FIG. 4 depicts a primary user interface display 400 in accordance with one embodiment of the present invention. By manipulating mouse 20 or some other input device, performer 200 moves a cursor over display 400. Performer 200 commands generation of a sound or a change of mode by depressing a button of mouse 20 when the cursor is over a particular icon of display 400. For example, display 400 includes 9 small iconic representations of guitars, 404, 406, 408, 410, 412, 414, 416, 418, and 420. These allow the user to select from 9 different guitar styles "nylon", "steel", "jazz", "clean", "muted", "overdriven", "distortion", "harmonics", and "MIDI". These correspond to the standard guitar play styles listed by the well-known MIDI specification. The last guitar style is actually a programmable instrument that although played in a guitar-like fashion need not sound like a guitar. For example, when MIDI guitar style is selected, the instrument may sound like a clarinet or a piano if desired.

Movement of the cursor across a strumming region 422 simulates strumming across the strings of an actual guitar. Display 400 also includes 5 LED icons 424, each allowing the user to select a different standard chord palette. The icon that is lighted represents the currently selected chord palette. The standard chord palettes are as follows.

| Function Keys | F1 | F2 | F3 | F4 | F5 | F6 | F7 | F8 | F9 | F10 | F11 | F12 |
|---|---|---|---|---|---|---|---|---|---|---|---|---|
| Palette #1 (Key of C major): | C | Dm | Em | F | G | Am | Bm7b5 | C7 | D7 | E7 | Fm | A7 |
| Palette #2 (Key of D major): | D | Em | F#m | G | A | Bm | C#m7b5 | D7 | E7 | F#7 | Gm | B7 |
| Palette #3 (Key of E major): | E | F#m | G#m | A | B | C#m | D#m7b5 | E7 | F#7 | G#7 | Am | C#7 |
| Palette #4 (Key of G major): | G | Am | Bm | C | D | Em | F#m7b5 | G7 | A7 | B7 | Cm | E7 |
| Palette #5 (Key of A major): | A | Bm | C#m | D | E | F#m | G#m7b5 | A7 | B7 | C#7 | Dm | F#7 |

A custom chord palette LED 426 allows the user to select a custom chord palette and appears as lighted when the custom chord palette has been selected. Selection of a chord palette display icon 428 causes a chord palette dialog box to appear. This dialog box is discussed below in further detail with reference to FIG. 5. Selection of an automatic play icon 430 causes an automatic play dialog box to be displayed as explained in reference to FIG. 7. Selection of a capo icon 432 causes a capo control dialog box to appear as explained in reference to FIG. 8.

Figure 5:
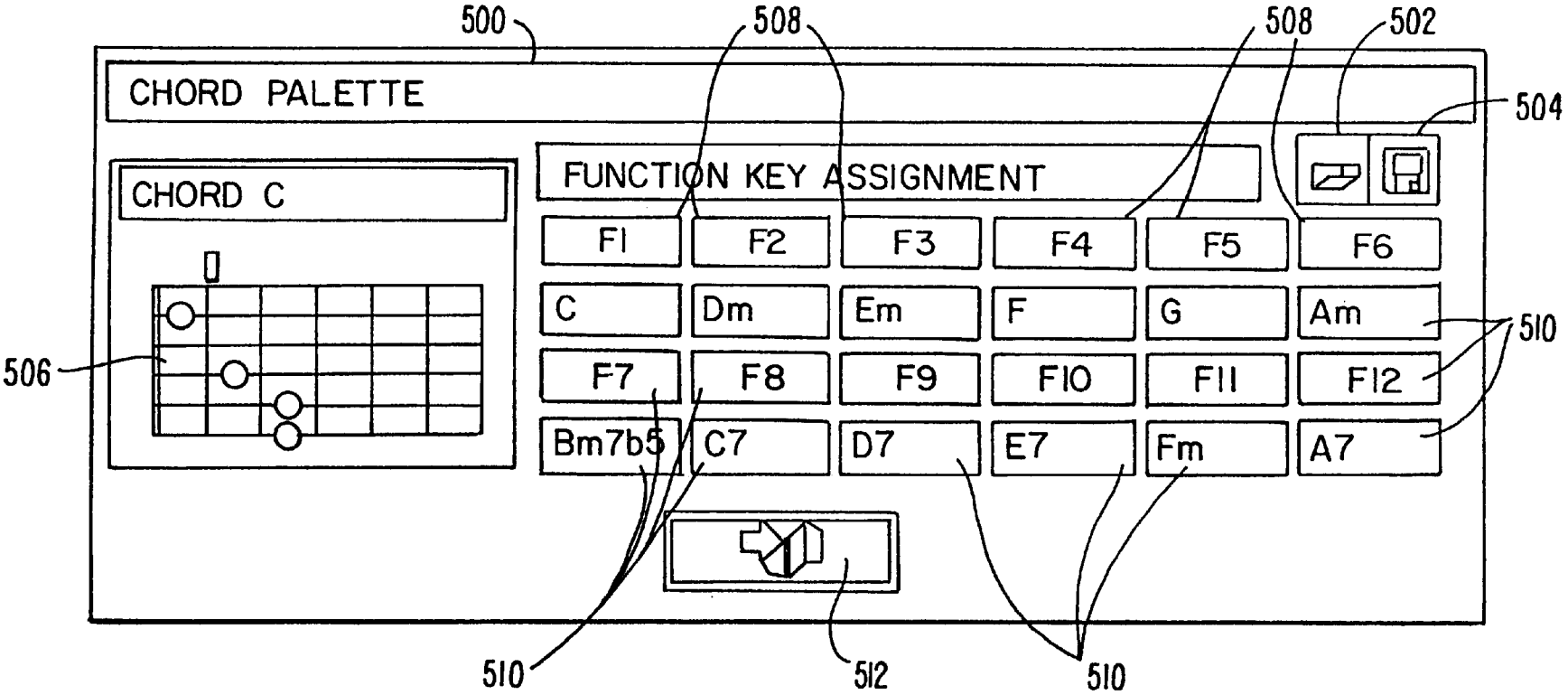
FIG. 5 depicts a chord palette dialog box in accordance with one embodiment of the present invention.

FIG. 5 depicts a chord palette dialog box 500 in accordance with one embodiment of the present invention. Chord palette dialog box 500 is displayed upon selection of icon 428. Selection of a load icon 502 initiates a series of well-known dialog boxes whereby performer 200 may identify and retrieve a file holding a previously stored custom chord palette. Selection of a save icon 504 initiates a series of well-known dialog boxes whereby the currently specified custom chord palette may be stored. A finger display 506 shows the fingering that would be used on a real guitar to play in the currently specified chord. Each function key has a representative button 508 displaying the name of the function key. Below the representative buttons 508 are chord title icons 510 giving the names of the chord assigned to the function key in the currently specified chord palette. If the chord palette is one of the five presets, the function key buttons 508, load icon 502 and save icon 504 appear dimmed and are unavailable. If the current chord palette is a custom chord palette, all of these are available for use.

Upon user selection of a function key button 508, a chord definition dialog box is displayed which allows performer 200 to select the chord to be assigned to the selected function key. By successive selection of function key buttons 508 and use of the chord definition dialog box to select a chord to correspond to each function key, the custom chord palette is defined. An exit icon 512 dismisses chord palette dialog box 500.

Figure 6:
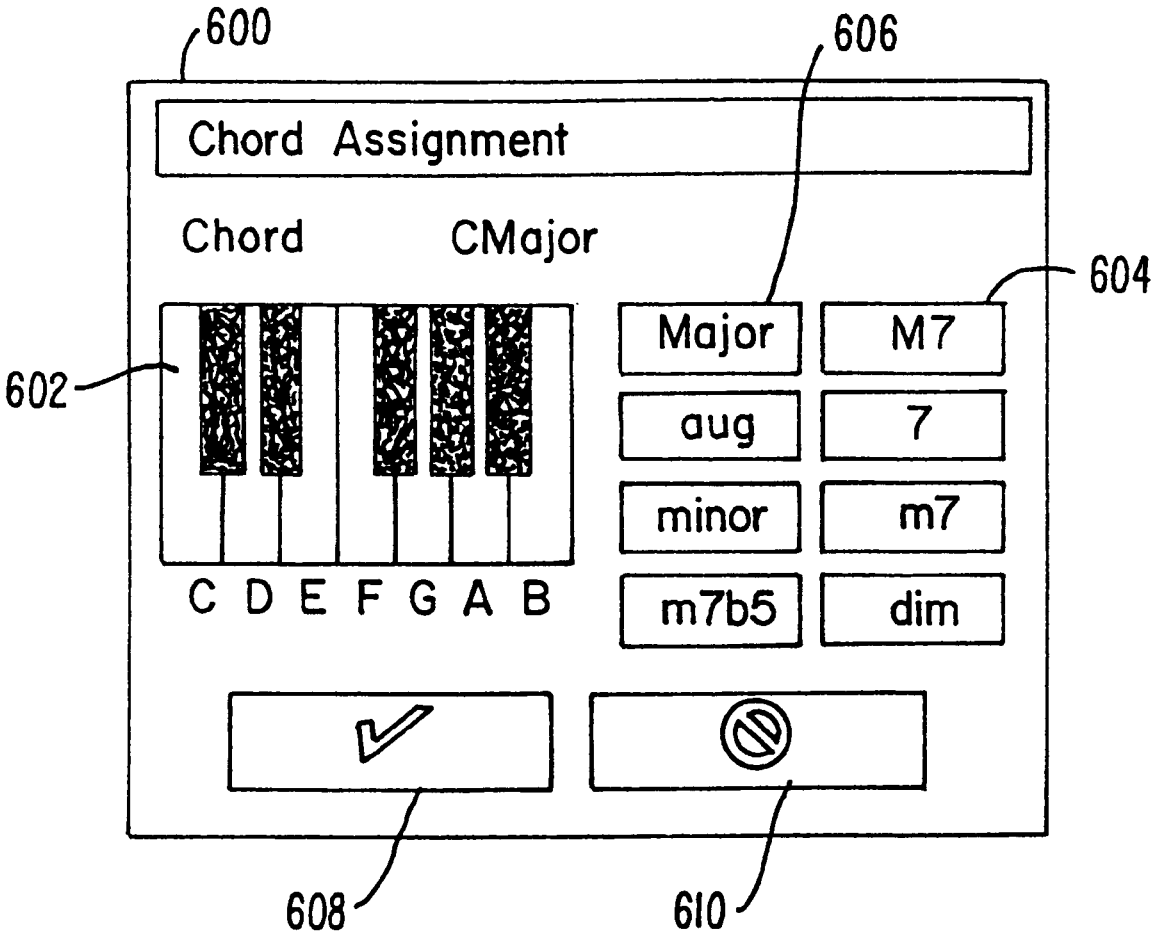
FIG. 6 depicts a chord definition dialog box in accordance with one embodiment of the present invention.

FIG. 6 depicts a chord definition dialog box 600 in accordance with one embodiment of the present invention. Chord definition dialog box 600 appears upon selection of a function key button 508 in chord palette dialog box 500. To fully specify a chord, performer 200 defines the chord root and the chord type. Chord definition dialog box 600 includes a chord root selection area 602 and a chord type selection area 604. Chord root selection area 602 includes an illustration of a mini keyboard. To define the chord root, performer 200 selects a key on the mini-keyboard. Any two adjacent keys are a semitone apart. Chord type selection area 604 includes eight buttons 606, each representing a different chord type. To define the chord type, performer 200 selects one of the eight buttons 606. When the chord type button 602 is selected, the sound of that chord is generated. Selecting an OK button 608 confirms the chord definition and dismisses chord definition dialog box 600. Selecting a cancel button 610 dismisses chord definition dialog box 600 without making changes.

Figure 7:
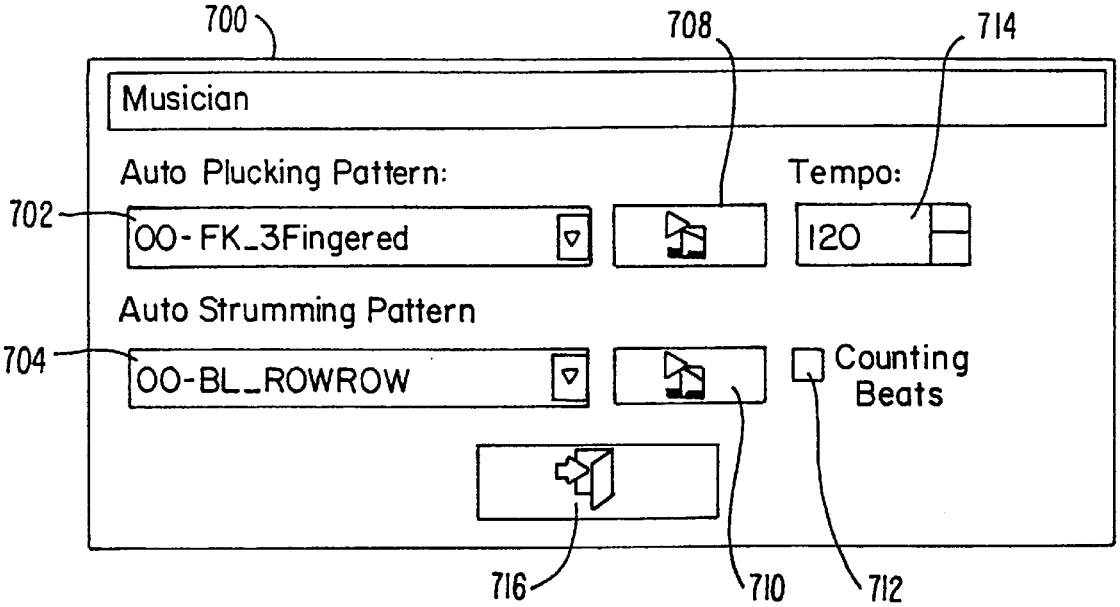
FIG. 7 depicts a dialog box for facilitating automatic guitar play in accordance with one embodiment of the present invention.

FIG. 7 depicts a dialog box 700 for facilitating automatic guitar play in accordance with one embodiment of the present invention. Selection of automatic play icon 430 causes automatic play dialog box 700 to appear. Performer 200 may select either automatic plucking or automatic strumming according to prestored patterns. An auto-plucking menu 702 permits selection of a prestored automatic plucking pattern. An auto-strumming menu 704 permits selection of a prestored automatic strumming pattern. Selection of a first start icon 708 initiates automatic plucking. Selection of a second start icon 710 initiates automatic strumming. The tempo for the strumming and plucking are defined in a tempo box 714. The automatic strumming and plucking patterns are features not found in a real guitar and make performing easier for beginners.

Performer 200 may also access automatic strumming and plucking features by depressing keys on keyboard 204. The "/" key activates automatic plucking, "*" activates automatic strumming, "+" increases the tempo and "−" decreases the tempo.

An automatic metronome feature is also available through dialog box 700 by checking a counting beat check box 712. A ticking sound is generated at a frequency determined by the current value entered in tempo box 714. Selection of an exit icon 716 dismisses automatic guitar play dialog box 700.

Figure 8:
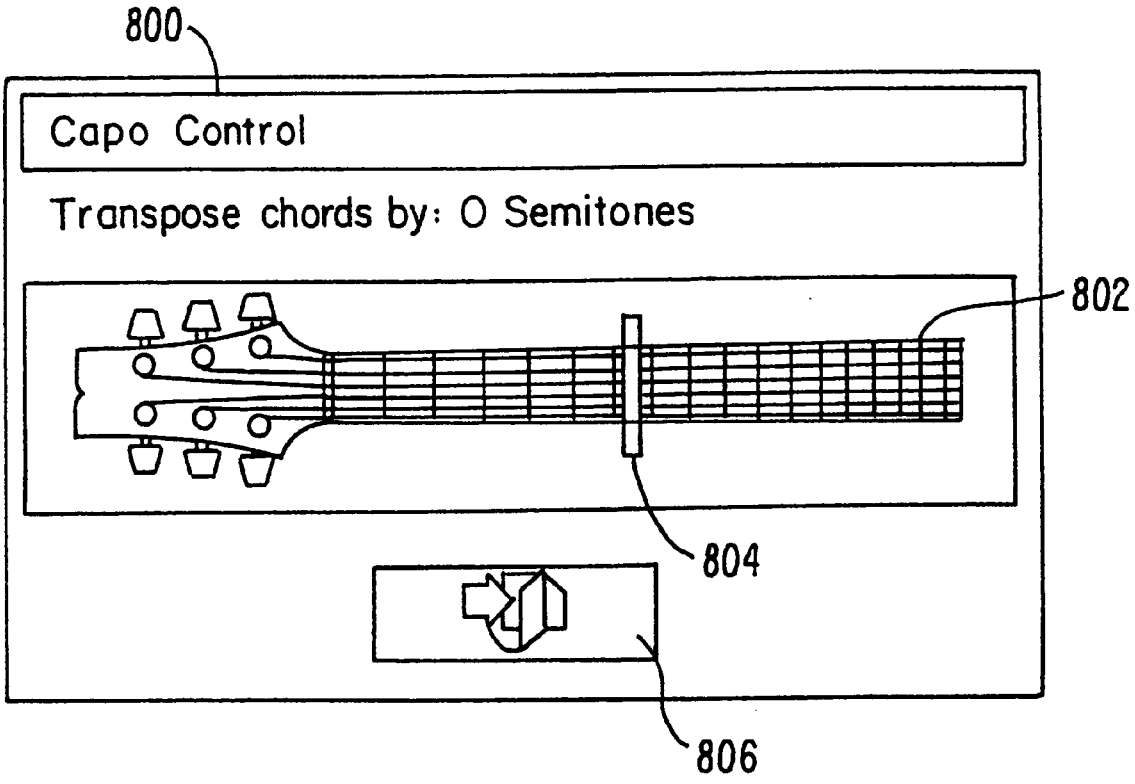
FIG. 8 depicts a capo control dialog box in accordance with one embodiment of the present invention.

FIG. 8 depicts a capo control dialog box 800 in accordance with one embodiment of the present invention. Capo control dialog box 800 appears upon selection of capo icon 432. Performer 200 makes selections in capo control dialog box 800 to simulate movement of a capo along the fretboard of a real guitar. The effect is to set a pitch offset of the currently selected chord. Capo control dialog box 800 displays a fretboard 802 with a capo 804. The default position of capo 804 is at the center of fretboard 802 indicating a zero pitch offset. Performer 200 adjusts the pitch offset by using mouse 20 to select capo 804 and then drag capo 804 along fretboard 802. Sliding capo 804 to the right shifts the pitch higher. Sliding capo 804 to the left shifts the pitch lower. This provides more flexibility than would be possible with a real guitar where the capo position furthest away from the guitar body is the zero pitch offset position and the capo can thus only be used to increase pitch. Selection of an exit icon 806 dismisses capo control dialog box 800.

Input to the user interface described above is used to control sound generation so that each plucking or strumming action whether it is automatic or initiated by performer 200 simulates guitar operation. An intermediate step is preferably preparation of MIDI data. Parameters for the generated sound include: whether an individual string has been plucked or strummed, the current temporal position in any automatic strumming or plucking pattern, which string has been plucked, which guitar style has been selected, which chord has been selected, and the current capo position. User interface controls are also provided for volume and tone (not shown). Sound synthesis makes use of wavetables, FM synthesis, or other well-known techniques as implemented on sound card 42.

The keyboard guitar system above provides a performance experience visually and aurally similar to a real guitar performance. Furthermore, it is easy to learn for the beginner.

In the foregoing specification, the invention has been described with reference to specific exemplary embodiments thereof. It will, however, be evident that various modifications and changes may be made thereunto without departing from the broader spirit and scope of the invention as set forth in the appended claims and their full scope of equivalents.

What is claimed is:

1. A computer-implemented method for simulating a string instrument comprising the steps of:

receiving from a personal computer keyboard a signal indicating depression of a particular key;

controlling musical output responsive to said key depression signal in accordance with a position of said particular key on said personal computer keyboard, wherein said position of said particular key is interpreted as corresponding to a particular position on said string instrument.

2. The method of claim 1 wherein said simulated string instrument is a guitar.

3. The method of claim 1 wherein two adjacent keys on said personal computer keyboard are a semitone apart.

4. The method of claim 1 wherein each selective ones of function keys on said personal computer keyboard corresponds to an associated chord.

5. The method of claim 1 wherein a selected key on said personal computer keyboard simulates plucking.

6. The method of claim 2 wherein said guitar is simulated to be one of "nylon", "steel", "jazz", "clean", "muted", "overdriven", "distortion", "harmonics", and "MIDI" guitar styles.

7. A computer-implemented method for simulating a guitar comprising the steps of:

receiving from a personal computer keyboard a signal indicating depression of a particular key; and controlling musical output responsive to said key depression signal in accordance with a position of said particular key on said personal computer keyboard, wherein said position of said particular key is interpreted as corresponding to a particular position on said guitar;

wherein said particular key is one of a plurality of function keys and said controlling step comprises selecting a chord for said musical output responsive to which one of said plurality of function keys was depressed.

8. The method of claim 7 further comprising the step of:

receiving user input specifying a mapping between particular chords and particular ones of said plurality of function keys.

9. A computer-implemented method for simulating a guitar comprising the steps of:

receiving from a personal computer keyboard a signal indicating depression of a particular key; and controlling musical output responsive to said key depression signal in accordance with a position of said particular key on said personal computer keyboard, wherein said position of said particular key is interpreted as corresponding to a particular position on said guitar;

wherein said particular key is in a numerical keypad portion of said personal computer keyboard and said controlling step comprises:

simulating a sound of a guitar string being plucked responsive to which key on said numerical keypad was depressed.

10. A computer program product for simulating operation of a string instrument, said product comprising:

code that controls an electronic device to receive from a personal computer keyboard a signal indicating depression of a particular key;

code that controls musical output responsive to said key depression signal in accordance with a position of said particular key on said personal computer keyboard, wherein said position of said particular key is interpreted as corresponding to a particular position on said string instrument; and a computer-readable storage medium for storing the codes.

11. The product of claim 10 wherein said simulated string instrument is a guitar.

12. The product of claim 10 wherein two adjacent keys on said personal computer keyboard are a semitone apart.

13. The product of claim 10 wherein each selective ones of function keys on said personal computer keyboard corresponds to an associated chord.

14. The product of claim 10 wherein a selected key on said personal computer keyboard simulates plucking.

15. The product of claim 11 wherein said guitar is simulated to be one of "nylon", "steel", "jazz", "clean", "muted", "overdriven", "distortion", "harmonics", and "MIDI" guitar styles.

16. A computer program product for simulating operation of a guitar, said product comprising:

code that directs a personal computer to receive from a keyboard a signal indicating depression of a particular key;

code that controls musical output responsive to said key depression signal in accordance with a position of said particular key on said personal computer keyboard, wherein said position of said particular key is interpreted as corresponding to a particular position on said guitar; and a computer-readable storage medium for storing the codes;

wherein said particular key is one of a plurality of function keys and said controlling code comprises code that selects a chord for said musical output responsive to which one of said plurality of function keys was depressed.

17. The product of claim 16 further comprising:

code that directs said personal computer to receive from said keyboard user input specifying a mapping between particular chords and particular ones of said plurality of function keys.

18. A computer program product for simulating operation of a guitar, said product comprising:

code that directs a personal computer to receive from a keyboard a signal indicating depression of a particular key;

code that controls musical output responsive to said key depression signal in accordance with a position of said particular key on said personal computer keyboard, wherein said position of said particular key is interpreted as corresponding to a particular position on said guitar, wherein said particular key is in a numerical keypad portion of said personal computer keyboard, and wherein said controlling code comprises code that simulates a sound of a guitar string being plucked responsive to which key on said numerical keypad was depressed; and a computer-readable storage medium for storing the codes.

19. A simulated string instrument system comprising:

a processor;

a personal computer keyboard;

a speaker;

a memory system storing sound data to be audiblized by said speaker and instructions to be executed by said processor, said instructions including:

instructions that control musical output through said speaker responsive to a position of a particular depressed key on said personal computer keyboard, wherein said position of said particular key is interpreted as corresponding to a particular position on said string instrument.

20. The system of claim 19 wherein musical output resulting from operation of said keyboard simulates operation of a guitar.

21. The system of claim 19 wherein two adjacent keys on said personal computer keyboard are a semitone apart.

22. The system of claim 19 wherein each selective ones of function keys on said personal computer keyboard corresponds to an associated chord.

23. The system of claim 19 wherein a selected key on said personal computer keyboard simulated plucking.

24. The system of claim 20 wherein said guitar is simulated to be one of "nylon", "steel", "jazz", "clean", "muted", "overdriven", "distortion", "harmonics", and "MIDI" guitar styles.

25. A simulated guitar system comprising:

a processor;

a personal computer keyboard;

a speaker;

a memory system storing sound data to be audiblized by said speaker and instructions to be executed by said processor, said instructions including:

instructions that control musical output through said speaker responsive to a position of a particular depressed key on said personal computer keyboard, wherein said position of said particular key is interpreted as corresponding to a particular position on said guitar;

wherein depression of a function key simulates selection of a guitar chord.

26. A simulated string instrument system comprising:

a processor;

a keyboard;

a speaker;

a memory system storing sound data to be audiblized by said speaker and instructions to be executed by said processor, said instructions including:

instructions that control musical output through said speaker responsive to a position of a particular depressed key on said keyboard, wherein said position of said particular key is interpreted as corresponding to a particular position on said string instrument, wherein depression of a numeric key of said keyboard simulates plucking of a guitar string.

* * * * *